US005249625A

United States Patent [19]

Skipper et al.

[11] Patent Number: 5,249,625

[45] Date of Patent: Oct. 5, 1993

[54] SOFT SET OVERSHOT FISHING TOOL

[76] Inventors: Uvon Skipper, 7409 S. Rice Ave., Bellaire, Tex. 77401; James W. Ward, HCR9 Box 207, Mena, Ark. 11953

[21] Appl. No.: 836,869

[22] Filed: May 8, 1992

[51] Int. Cl.[5] ..... E21B 31/18

[52] U.S. Cl. ..... 166/98; 166/187; 294/86.32; 294/119.3

[58] Field of Search ..... 166/178, 301, 98, 187, 166/242, 243; 294/86.15, 86.32, 119.3; 277/34, 34.6

[56] References Cited

U.S. PATENT DOCUMENTS 3,542,354 11/1970 Fitzpatrick ..... 294/119.3 X
4,052,861 10/1977 Malone et al. ..... 294/86.15 X
4,989,909 2/1991 Bouligny, Jr. et al. ..... 294/119.3

FOREIGN PATENT DOCUMENTS 2814915 10/1978 Fed. Rep. of Germany ... 294/119.3

*Primary Examiner*—Terry Lee Melius
*Attorney, Agent, or Firm*—Gunn & Kuffner

[57] ABSTRACT

A fluid operated overshot with an outer metal mandrel internally supports a resilient internal sleeve. The sleeve telescopes over a fish to grip the fish on expanding radially inwardly. This expansion is fluid powered by applying a force to the inner sleeve to expand inwardly from a piston which compresses the sleeve, or form surrounding the inner sleeve in a concentric fluid receiving cavity.

19 Claims, 4 Drawing Sheets

SOFT SET OVERSHOT FISHING TOOL

BACKGROUND OF THE DISCLOSURE

The present disclosure is directed to a fluid operated fishing tool and more particularly to one which has a soft contact or a soft set tool. It is especially adapted for use in grasping and holding a fish (an item to be retrieved) which does not necessarily have an easily gripped upper end such as a drilling motor stem. It will be discussed in the context of retrieving a typical elongate cylindrical device that may have a smooth upper end, and particularly one which does not have a spear head, or indeed, a fish of any shape.

The fishing tool of the present disclosure is a type of retrieval tool or overshot which reaches around and grasps the fish. It is constructed with a soft set or soft touch mechanism. The soft set mechanism is especially desirable in light of the varied size and shape of the upper end of the fish. The shape of the fish may be known, but in some instances, it is completely unknown. Likely, it will be an elongate device having no particular anticipated shape. Whatever the case, the present device is constructed to reach over the fish and surround the upper end of the fish. The fish can be shredded, twisted, bent, or otherwise parted. It can just as easily be an elongate cylindrical member which simply has no shoulders, no threads, no undercut shoulder, no serrations or knurled surface, etc. It can be smooth metal or rough with no limit. This soft set structure reaches over the fish and conforms to the fish regardless of its shape. The fish is gripped by a surrounding resilient sleeve which is on the interior of the present overshot device. This sleeve fits around the fish with some clearance. The sleeve is on the interior of a cylindrical housing. By the proper actuation of the present device, fluid pressure is applied behind the sleeve so that the sleeve expands radially. It expands inwardly to grasp the fish which is enclosed within the sleeve. The upper end of the sleeve is free floating on a sealed surface of a stem which construction allows the sleeve to contract. The sleeve floats to enable it to conform to the fish. By having the top free floating, the sleeve material is in compressed when a pull is exerted. This allows for more strength in the tool. Also, the weight of the fish tends to help set the sleeve when coming out of the hole. While the present apparatus is able to transfer a tremendous amount of pulling force to the fish, there is the possibility that the fish will not break free. In that instance, it is then desirable that the fish be released. The present apparatus includes a mechanism by which release is accomplished. The soft set tool is set by pumping incompressible fluid behind the sleeve. That space is later evacuated of high pressure fluid and the pressure is released by dropping a ball to seat on a pinned sleeve. A predetermined pressure will shear the pins and move the sleeve downward to open access ports to the pressure chamber. The same movement opens ports to the annular area to eliminate the problems of pulling a wet string. This enables release of the fish and permits relaxation of the sleeve. In that instance, the sleeve will relax and expand radially outwardly for restoration to its original shape, and thereby release the fish. This makes retrieval of the fishing tool something easily done when the fish cannot be readily moved.

In very general terms, the tool of the present disclosure threads to a tubing string which enables the tool to be lowered in a well where a fishing job is to be conducted, and extend over the fish. The tool incorporates an elongate cylindrical upper end which has two internal sleeves which are selectively plugged by dropping a specifically sized ball in the tubing string. Dropping the smaller ball initiates seating on the lower sleeve, shutting off circulation thru the tool and allowing a predetermined pressure to be applied in the pressure chamber to set the soft set grapple. The same pressure will shear the sleeve pins. This allows the sleeve to move downwardly to open ports to the annular area, thereby establishing circulation. The setting pressure is retained in the setting chamber by back pressure valves. This ball stops flow axially of the tool and diverts the flow into a passage in the sidewall. This passage is ordinarily closed when flow is axially through the tool, closure being accomplished by a spring actuated check valve. When the check valve is overpowered, it delivers fluid under pressure controlled at the wellhead so that pressure build-up occurs in a chamber within the tool. The chamber is concentric around and coextensive along a resilient sleeve which is forced to shrink radially inwardly by the surrounding fluid pressure. This pressure causes the resilient material of the sleeve to conform against the surface of the fish and to grasp the fish so that it is held. As will be detailed substantially with the development of the present disclosure, the fish is held so that axial pulling can occur, hopefully retrieving the fish in the fashion of an overshot retrieval too. In the event that the procedure requires later release of the fish, a larger ball is dropped in the tubing string and lands on a larger bore seat at the upper end of the tool. By increasing pump pressure at the wellhead, this sphere in conjunction with a moveable sleeve is moved downwardly, breaking a set of shear pins. When it moves, the sleeve closes off or blocks the lateral passage by which fluid is introduced around the sleeve. Moreover, this enables a passage to be actuated which voids the chamber around the sleeve so that any build-up of pressure in that area is relieved. This permits the sleeve then to relax. Moreover, the downward movement opens a passage above the ball seat to establish circulation. This eliminates the necessity of pulling a wet string, reducing mud spillage. In this type of operation, the tool also has fill-up valves at the bottom of the tool and air release valves at the top. Both of these valves close when adequate pressure is achieved in the setting chamber.

An important additional aspect for accomplishing the soft grab is changing the pressure chamber from around the grasp sleeve pressure cylinder above the soft grasp sleeve with a piston which, when pressure is achieved is applied, will compress the soft sleeve, thus conforming it to the fish shape. In this mechanism, the bottom fill up valves are replaced by drain holes in the outer sleeve. This is necessary to void any fluid contained behind the soft grasp sleeve to allow complete sleeve compression around the fish. It is also necessary to adapt a piston to seal off on the outer sleeve to effect the compression force.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1A:
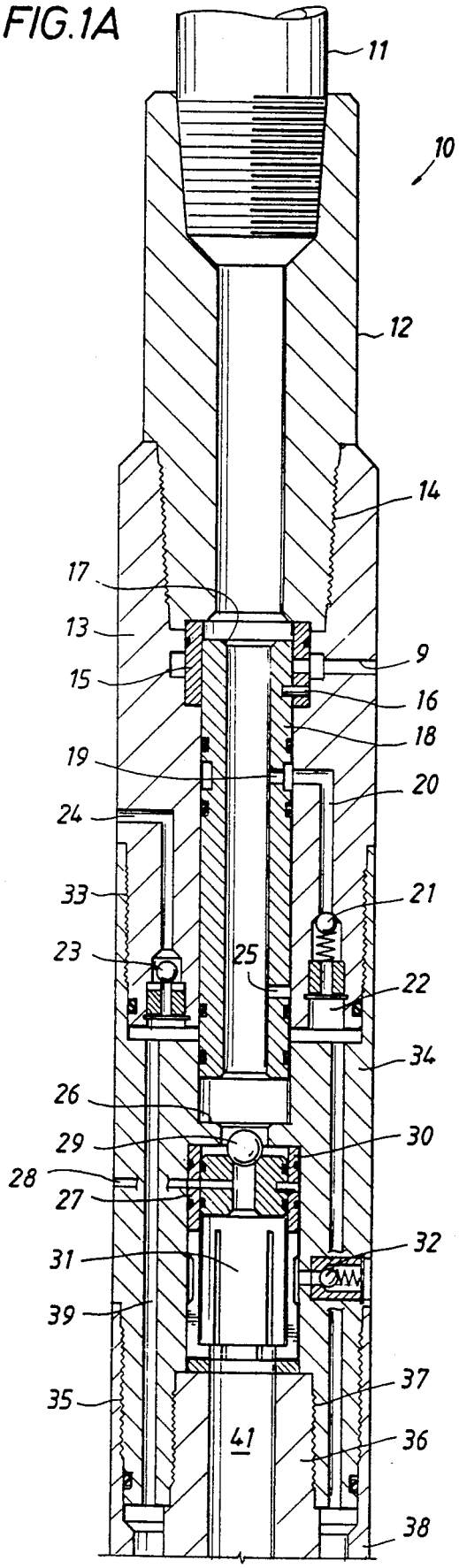
FIG. 1 is an elongate sectional view of the elongate tool in three portions identified as FIGS. 1A, 1B, and 1C which collectively show a sectional view through the length of the tool from the top to the lower end with the tool in the relaxed state so that a fish shown in dotted line can be positioned within the resilient sleeve for grasping and subsequent retrieval.

Attention is directed to FIG. 1 of the drawings which will be described in detail proceeding from the top to the bottom. This description sets out particulars of the construction and operation of the embodiment 10 which is shown in three segmented views which are longitudinal sectional views of the elongate cylindrical device. The tool 10 is connected to a tubing string, and the top joint of the tubing string 11 is shown. A sub 12 is provided with conventional threads to locate a box end at the upper end of the tool 10. The sub threads to an elongate thick wall housing 13 by means of a threaded connection 14. An internal sleeve 15 is included at an internal shoulder within the housing 13, and one or more appropriate shear pins 16 are included. An externally connected passage 9 opens through the wall of the housing 13 and the short sleeve 15; the inner sleeve 18 closes the passage 9 which is controllably opened in FIG. 6. The shear pin 16 extends radially inwardly to fasten in an upward location a larger sleeve 18. The number of pins, diameter and hardness of metal determines the force required to shear the pins. The force is changed by modification of these variables. The sleeve 18 has an upper end shoulder 17 which is included to catch an support a large sphere as will be described with respect to FIGS. 5 and 6 jointly. The sleeve 18 is constructed with a radially directed passage 19 which connects to an external groove around the sleeve 18 which aligns with a high pressure passage 20. The passage 20, there being several such passages in the housing 13, extends downwardly to a pressure operated check valve 21. Flow upwardly is forbidden by the check valve cooperative with the valve seat. Flow downwardly does not occur until the force of its bias spring is overcome. Flow downwardly through the passage 20 is delivered into an annular chamber 22. The chamber 22 has two or three such check valves delivering flow into it, and it also communicates with bleed valves 23, two or three in number, preferably opening to the exterior by means of an air bleed passage 24 which vents to the exterior. One or several passages are used in the system. The passages 24 do not permit flow if the check valve 23 is raised by the flow and contacts against the seat above the check valve element. The check valve, however, is able to move downwardly. It moves downwardly where it rests on a crenalated support sleeve, this sleeve providing support so that air can flow past the check valve without raising it. When drilling mud is introduced into this annular chamber, the increase in fluid density of the mud raises the check valve element 23 and causes it to close. This drains the annular chamber 22 of air but limits the escape of drilling fluid.

The tool 10 has an axial central passage which is open to fluid flow. Fluid flow proceeds directly downwardly through the tubing string 11 and through the sleeve 18 in ordinary circumstances. However, fluid flow is also permitted to be diverted through the lateral passage 19 so that it enters the passage 20 and proceed downwardly in the housing as described. There is another lateral passage through the sleeve 18 at 25, but this passage does not align for lateral flow as shown in FIG. 1A. Later, it will move down to align with the annular chamber 22. That assures that the chamber 22 can drain into the sleeve 18 to reduce pressure in the chamber 22.

The sleeve 18 is pinned in the up position in FIG. 1A. There is a range of travel permitted for it so that it can move downwardly until it abuts against the shoulder 26. The shoulder 26 limits downward travel. Below the shoulder 26, there is a more narrowly defined passage in the movable sleeve 27. This particular sleeve again is pinned in location by one or more shear pins. Its passage is more narrow, and it therefore will not permit passage of a sphere 29 which is dropped in the tubing string for the purpose of starting operation. The ball or sphere lands on the sleeve 27 to plug that sleeve. On the increase of pressure applied to the tool string, the sleeve then is able to move. The sleeve 27 covers over a bleed passage 28 to the exterior of the tool 10 so that any standing well fluid captured above the ball 29 and sleeve 27 is permitted to bleed to the outside. This decreases the amount of spillage when the tool 10 is pulled from the well. The sleeve 27 is pinned to a surrounding cage 30 which incorporates a set of slots 31 at the lower end which extend along the cage 30. The shearing force required to move the sleeve 27 is correlated with the setting pressure necessary to set the soft grasp element so that when the selected pressure is reached, the sleeve 27 moves down. The pressure below the packoff sleeve 27 is relieved thru the pressure opened valve in the passage 32. This is necessary because the pressure fluid below will be contained or trapped between the sleeve 27 and the soft set grasping element to be described. The slots have a surrounding external groove registered with a lateral passage to the exterior of the tool, the passage 32 being incorporated to direct fluid flow from the axial passage to the tool exterior to assure that there is no relative pressure differential between the inside of the tool and the exterior. The axial passage through the sleeve 27 extends farther into the next set of structural components as will be described.

Figure 1B:
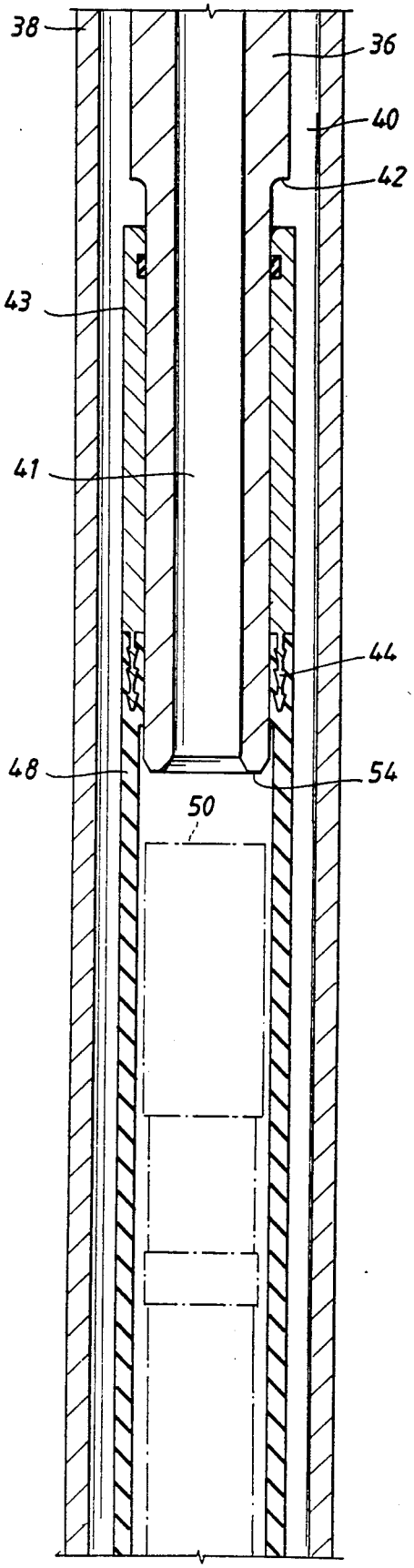

The housing is formed of multiple components. A threaded connection at 33 is located where disassembly can easily occur to construct and install the check valves illustrated in FIG. 1A; this threaded connection enables the housing 13 to be extended therebelow by the incorporation of the next housing section 34, and that extends downwardly to the next threaded connection at 35. This enables the next housing section to be attached which, at this juncture, has the form of internal and external concentric spaced apart structural elements which define an annular flow space. There is therefore an inner mandrel 36 with the threads 37 on the lower end of the housing piece 34. There is also an outer component 38 which is concentric thereabout and which makes the threaded connection 35. These two mandrels 36 and 38 define a gap 40 therebetween in FIG. 1B. This annular chamber 40 will be discussed in some detail hereinafter, it being noted that the chamber 40 is provided with fluid flow passages 39 at multiple locations in the housing section 34 thereabove. Moreover, these two concentric pieces which define the chamber 40 also continue to define the central flow passage 41 downwardly through the tool so that it extends as shown in FIG. 1B. The inner mandrel 36 is constructed with a shoulder 42 which supports a resilient sleeve alignment ring 43. The ring 43 is able to telescope on the mandrel 36. The mandrel 36 is provided with the downwardly facing shoulder 42 as mentioned and is able to guide and limit movement of the ring 43. The chamber 40 is on the exterior of the mandrel 36. The mandrel 36 terminates below the shoulder 42, and at the region, it incorporates a surface which permits sliding movement of the ring 43. The ring 43 provides stiffness and alignment for axial sliding movement of an expandable resilient sleeve 48. The sleeve 48 is stiffened by the ring 43 at the upper end, the ring joined by means of an anchor ring 44 recessed internally and bonded to the resilient material forming the sleeve. The ring 43 the sleeve 48 retain fluid pressure where they contact the mandrel 42. The sleeve 48 is preferably formed of resilient material having physical characteristics of rubber. The precise material can be varied depending on the degrees of flexibility required, the temperatures of the well during tool use, and other details relating to its operation.

A fish is indicated in dotted line by the numeral 50. This is typical of the type of device retrieved through the use of the present invention. Moreover, it is illustrated with no underside shoulder which enables a grappling tool or overshot having a bowl wedging inwardly a set of collet fingers with serrations to grasp the fish. Also, the fish may or may not have a conventional cylindrical shape, and the fish may or may not be smooth. Here, it will simply be assumed that the fish is difficult to grasp because it is an elongate member such as a pipe without a cylindrical shape. The resilient sleeve 48 is positioned about the fish by stabbing the fish into the soft set overshot 10 of this disclosure. At the juncture, no particular grip has been accomplished. The stabbing action can occur while drilling fluid is circulated downwardly through the passage 41 shown in FIG. 1B and flows over the fish to assure easy nesting of the fish in the sleeve 48. As shown now in FIG. 1C, the sleeve 48 is the primary component which surrounds and grasps the fish. To be sure, the outer body 38 extends around and below the fish, but it does not engage the fish in the sense of grasping it. The outer body or mandrel 38 threads to a bowl 51 which has an inner tapered face or surface 52. This connects with an enlarged skirt 53 which enables the device to surround part or most of the fish. The fish is aligned in the bowl 51 and is forced upwardly so that it registers in the resilient sleeve 48. The fish is permitted to stab as deeply as possible into the soft set overshot until it shoulders against the downwardly facing shoulder 54, better shown in FIG. 1B as part of the inner mandrel 36.

The bowl 51 threads to the outer body 38 at a set of threads 55, and the bowl at its upper shoulder supports a ring 56. The ring 56 is drilled with a radial passage 57 which opens into a fill up valves assembly at 58. When drilling fluid is encountered in the bore while running the tool into the hole, the chamber 40 starts to fill from the bottom thru the fill up valve 58 in FIG. 1C. Air escapes through the bleed valves 23. Pressure is induced through the check valves 21. Fluid rises in the chamber until the chamber fills through the valves 58 and air release valves 21 are enclosed. This enables the chamber 40 to fill from the bottom, and forces evacuation of any air bubbles that might be in the chamber 40. The bubbles float upwardly and are evacuated as previously mentioned. The air bubbles are evacuated so that only incompressible fluid is then captured in the chamber 40. The incompressible fluid fills the chamber. It then is able to provide pressure against the sleeve 48 to force it radially inwardly. This chamber 40 is isolated at the lower end of the sleeve 48 by virtue of an anchor ring 60 integrally constructed with the ring 56. This assures that the sleeve does not leak at the lower end.

Figure 1C:
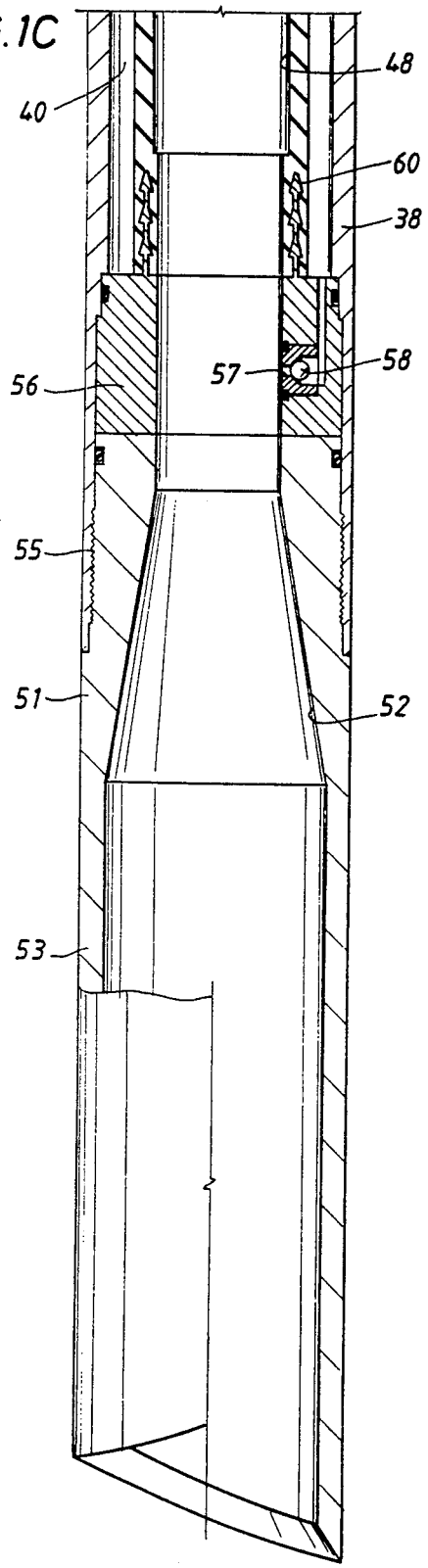
Figure 2:
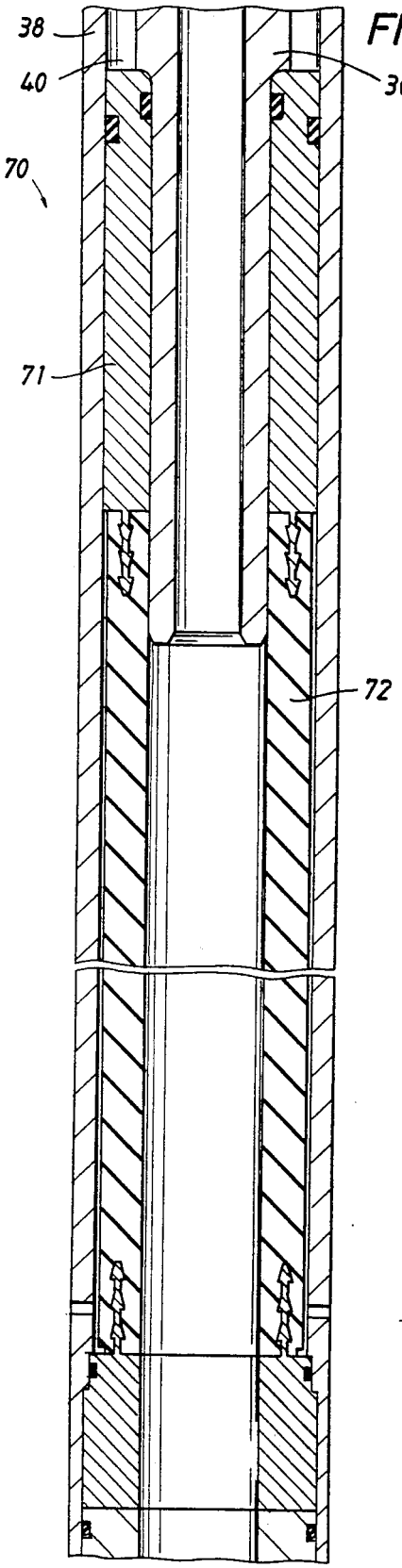
FIG. 2 is a view showing an alternate form of resilient sleeve which is expanded radially inwardly to grasp a fish for retrieval.
Figure 4:
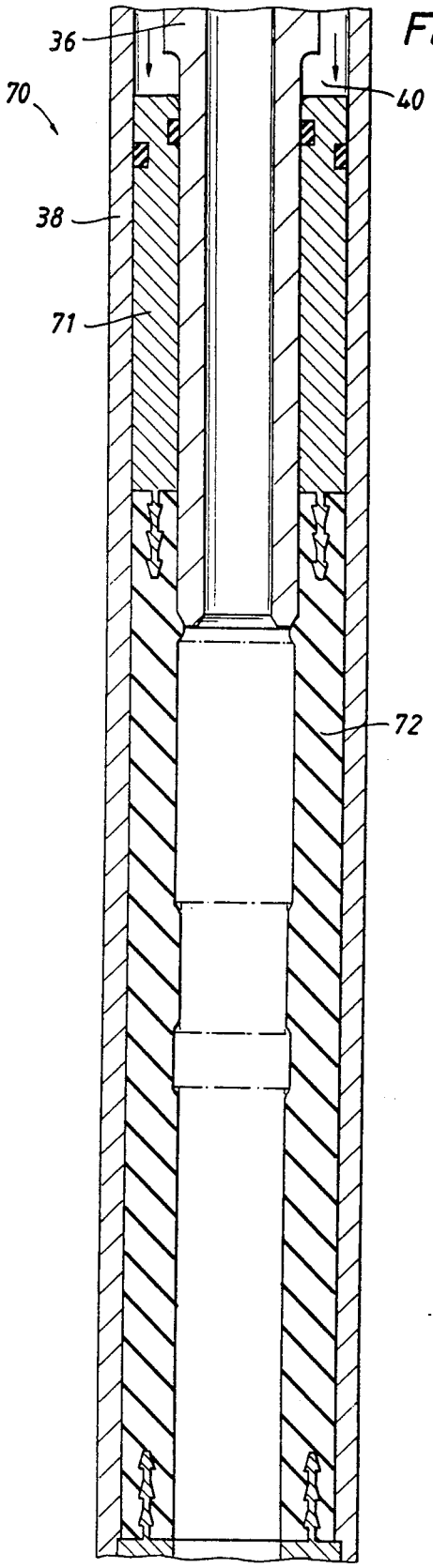
FIG. 4 is a view of the alternate form shown in FIG. 2 grasping a fish to be retrieved wherein the resilient sleeve is actuated in a different fashion compared with the structure of FIG. 3.

Attention is now directed to Fig. 2 of the drawings which shows a portion of the tool with a modified sleeve construction. This will be identified as the embodiment 70. It is similar in the upper portions. To this end, it also incorporates the inner mandrel 36 concentric within the same outer body 38 as previously mentioned. The annular flow space 40 again is incorporated but it is plugged as shown in FIG. 2 by means of a ring shaped plug 71. The plug is sealed on the interior and exterior cylindrical surfaces so that the plug does not permit fluid to flow therebelow. The cylindrical plug functions as a movable piston. Moreover, the plug connects with a modified form of resilient sleeve 72. The sleeve 72 has a greater wall thickness so that it expands radially inwardly when axially compressed by movement of the metal piston 71. The lower end of the plug is anchored in the same fashion as shown in FIG. 1C and hence that part of the structure differs only in the increased thickness of the sleeve 72. The lower end of the structure thus follows the same description applied to FIG. 1C with regard to that portion of the apparatus. The sleeve 72, when subjected to axial loading, expands radially outwardly and inwardly, but outward expansion is fairly well constrained by the close spacing of the resilient sleeve 72 within outer body 38. Because of this lack of space on the exterior, any expansion is directed inwardly to engage by gripping a fish which is caught within this particular embodiment 70. Operation of the structure 70 illustrated in FIG. 2 will be detailed with regard to FIG. 4 of the drawings.

AN EXAMPLE OF OPERATION OF THE ILLUSTRATED EMBODIMENTS

Figure 3:
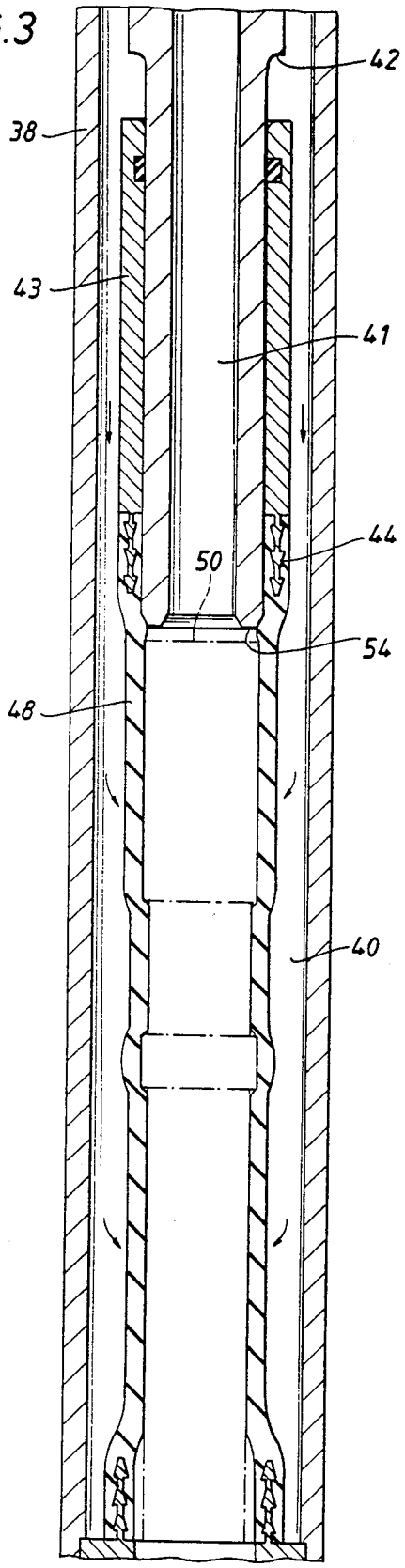
FIG. 3 is a view showing the resilient sleeve of FIG. 1 forced radially inwardly to grasp an irregularly shaped object exemplified in dotted line as a result of external pressure applied on the exterior of the resilient sleeve.

Assume that a fish has been registered within the soft set overshot 10. Assume that fluid has been pumped through the tubing string from the surface and that the operator is then ready to retrieve the fish. The ball or sphere 29 is dropped in the mud flow and is delivered through the tubing string and ultimately lands as illustrated in FIG. 1A. Prior to that, fluid flow was down through the tool 10 so that the interior and exterior of the tool were at a common pressure. At that juncture, the tool is not set. When the sphere 29 lands at the illustrated location shown in FIG. 1A, continual pumping through the tubing string results in an increase in flow into the passage 20 shown in FIG. 1A, flowing downwardly past the check valve 21 and filling the annular chamber 22. It flows downwardly through the passages 39 to fill the annular chamber 40 shown in FIG. 1B. Any air that might have been captured in that area bubbles to the top and escapes through the bleed valve 23 provided for that purpose. When drilling fluid starts flowing in that area, the bleed valve element 23 closes, thereby capturing incompressible fluid in that chamber so that squeezing can occur. As the pressure at the wellhead is then increased, the increase in pressure is observed in the annular chamber 40 on the exterior of the resilient sleeve 48. Contrasting that sleeve in the relaxed state in FIG. 1B, it will be observed in FIG. 3 to expand, but the expansion forces the resilient material radially inwardly in response to pressure so that it grasps the fish and engages the fish 50 by taking on the shape of the fish. The setting pressure is sufficient to develop the force necessary to shear the pins and allow the sleeve 27 to move downward. The downward motion will expose the drain holes 28 to dump the fluid in the string so that the fish may be retrieved without pulling a wet string. Since the resilient sleeve will set around the fish, and the ball is in place atop the sleeve, the valve controlled passage 32 relieves the trapped pressure fluid caused by the downward travel of the sleeve 27. The fish is gripped around a very large portion of its area, and in particular that portion in registry with the sleeve so that the fish is firmly and tightly held. Moreover, the resilient sleeve, now in this gripping shape, is able to impart a lifting force to the fish. A pull is taken on the tubing string and the soft set overshot 10 is then raised, and this of course raises the fish 50 if it will break free. In the ordinary circumstance, it will break free and is retrieved, held snugly and firmly in the resilient sleeve as shown in FIG.3 of the drawings. Assuming this is successfully done, the tubing string is retrieved to the surface along with the soft set overshot 10 and the fish 50. The grip of the sleeve on the fish is enhanced by reaction of the resilient material holding tighter as it is pulled. The results from the tendency of the resilient sleeve to tighten around the fish when the tool 10 is pulled.

Figure 5:
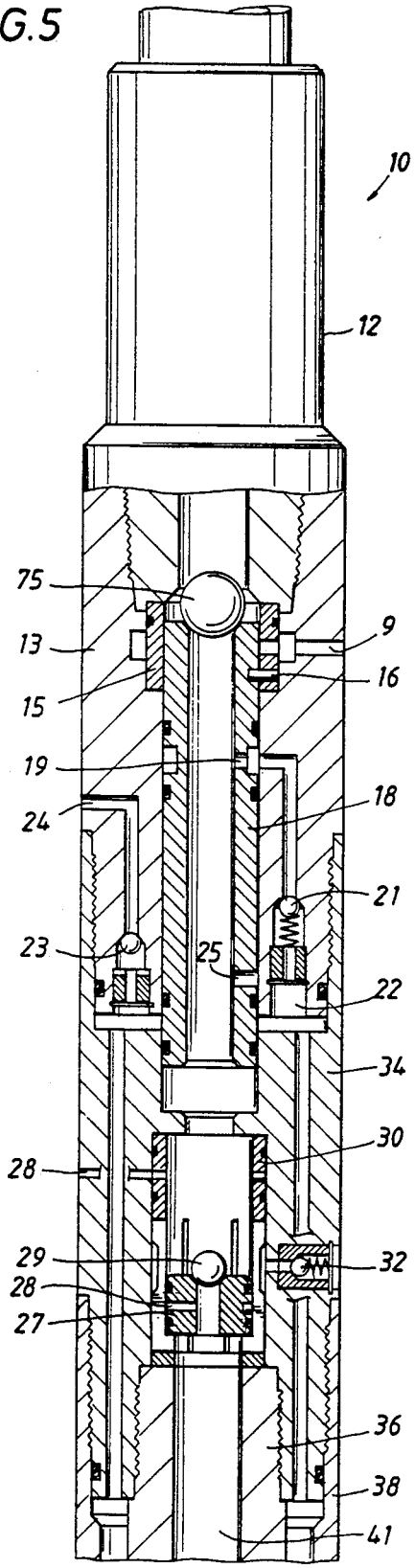
FIG. 5 is a view showing a larger sphere dropped in the tubing string and landing at the top end of a sleeve for releasing the setting pressure and opening circulation to the annular area.
Figure 6:
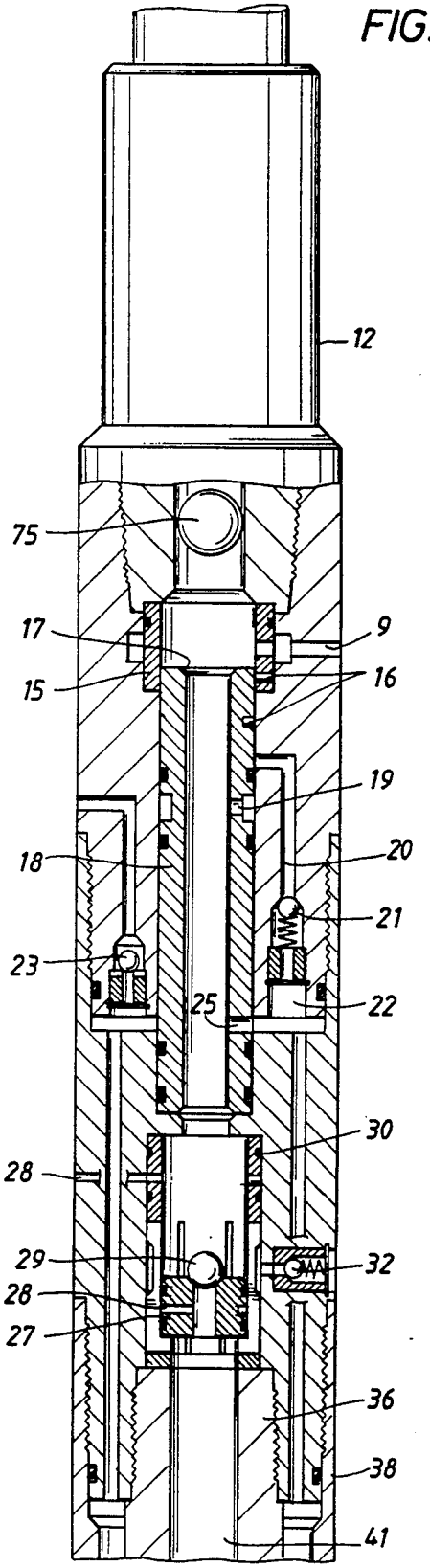
FIG. 6 is a view of the tool similar to FIG. 5 but showing the sleeve forced downwardly by pressure fluid from the wellhead sufficiently to break a set of shear pins for moving the sleeve so that no fluid is behind the resilient sleeve and the annular ports are open.

In some instances, the fish may not bread free. If that occurs, it is then important to then release the fish. To accomplish release attention is now directed to FIGS. 5 and 6 of the drawings which show how this is accomplished. A larger sphere 75 is dropped into the equipment. Recall from FIG. 1A that the smaller sphere 29 is dropped into the equipment and it travels so far down into the equipment that the sleeve 27 is engaged by it and the shear pin 28 is broken. This interrupts fluid flow downwardly through the arrangement as shown in FIG. 1A. Accordingly, the sleeve 27 remains in the down position as shown in FIG. 5 of the drawings. Now, the larger sphere 75 is also shown in FIGS. 5 and 6. This sphere is sized so that it will not pass the shoulder 17 at the upper end of the sleeve 18. The sleeve 18 is plugged by the ball, and on the increase of fluid pressure, the sleeve 18 is forced downwardly, breaking the shear pin 16. When it breaks, the sleeve 18 moves downwardly, better shown in the contrast between FIGS. 5 and 6. When it moves downwardly, the port 25 lines up with the radial passage to drain the annular chamber 22. Moreover, the lateral passage 19 is shifted so that it does not line up with the passage 20, and the incompressible fluid which is captured in the chamber 40 is no longer able to sustain a pressure differential acting on the resilient sleeve, causing it to swell against the fish for retrieval.

At this juncture, pressure differential across the resilient sleeve 48 is released and it is free to expand, restoring its original shape. This enables the fish 50 to be released by pulling on the tool. Also, when the sleeve 18 is moved downward, it opens ports 9 to the annular area to eliminate having to pull a wet string.

The foregoing description applies both to the embodiment 10 and to the embodiment 70. The fluid release just mentioned occurs in both version. The fluid release is accomplished in the embodiments 10 and 70 both. They differ only in the nature of the rubber forming the sleeves as previously explained.

After release, the tubing string can then be retrieved and pulled from the well with the tool 10 or 70 attached, and the fish is then left in place.

While the foregoing is directed to the preferred embodiments, the scope is determined by the claims which follow.

What is claimed is:

1. A soft set overshot comprising:

(a) an elongate outer mandrel to encircle around a fish;

(b) an elongate inner sleeve within said outer mandrel and having an axial passage to fit around and over the end of the fish wherein said inner sleeve fits within said outer mandrel to position said sleeve around and about the fish;

(c) means fixedly securing the lower end of said sleeve in said outer mandrel;

(d) means acting on said inner sleeve to expand said inner sleeve radially inwardly to grip and hold a fish in said sleeve wherein said acting means controllably releases to enable release of the fish from said sleeve; and (e) elongate inner mandrel concentric within said outer mandrel to join to an upper end of said sleeve to position said inner sleeve prior to expansion.

2. The apparatus of claim 1 wherein said inner sleeve is formed of resilient material and expands radially inwardly in a grip on the fish.

3. The apparatus of claim 1 wherein said inner and outer mandrels define a fluid receiving chamber external of said sleeve to enable fluid in said chamber to form a fluid initiated force acting against said sleeve to expand said sleeve radially inwardly.

4. The apparatus of claim 3 including a well fluid flow path connected from a tubing string supporting said overshot wherein said flow path connects to said fluid receiving chamber for expansion of said chamber to enable fluid initiated sleeve expansion radially inwardly.

5. The apparatus of claim 4 including a control sleeve and cooperative sleeve moving element controllably moving said control sleeve to admit fluid flow into said fluid receiving chamber.

6. The apparatus of claim 5 wherein said control sleeve is initially in a position to permit fluid flow and moves to a second position to direct fluid flow to said fluid receiving chamber.

7. The apparatus of claim 6 wherein said control sleeve blocks flow into a passage connected into said fluid receiving chamber when located in the second position.

8. The apparatus of claim 7 wherein said sleeve moving element is a means dropped in fluid flow along a tubing string connected to the present overshot and lands in a blocking position on said control sleeve.

9. The apparatus of claim 8 wherein said control sleeve covers a laterally directed fluid flow passage connected to vent fluid flow to the exterior of said overshot.

10. The apparatus of claim 9 including a second control sleeve having a first position to define a fluid flow pathway to said fluid receiving chamber, and wherein said second control sleeve moves to a second position to block fluid flow to said fluid receiving chamber.

11. The apparatus of claim 10 including a fluid moved piston in said fluid receiving chamber movable in response to fluid in said chamber to compress said sleeve axially to cause expansion radially inwardly.

12. The apparatus of claim 10 wherein said fluid receiving chamber is concentric about said sleeve to expand said sleeve radially inwardly.

13. The apparatus of claim 12 wherein said inner sleeve is mounted at a pair of spaced ends thereof in said outer mandrel to define a surrounding and elongate fluid receiving chamber and said chamber is connected by a vent passage through venting valve means to enable gas venting.

14. The apparatus of claim 13 wherein the ends of said sleeve join to circular rings at said ends, said rings mounting to enable relative elongation of said sleeve.

15. The apparatus of claim 11 including an inner mandrel concentric within said outer mandrel to support said fluid moved piston for movement wherein said piston is sealed against leakage therepast, and said piston has the form of a circular, axially hollow number.

16. A soft set overshot comprising:

(a) an elongate outer mandrel to encircle around a fish;

(b) an elongate inner sleeve within said outer mandrel and having an axial passage to fit around and over the end of the fish wherein said inner sleeve fits within said outer mandrel to position said sleeve around and about the fish;

(c) means fixedly locating the lower end of said sleeve in said outer mandrel;

(d) means acting on said inner sleeve to expand said inner sleeve radially inwardly to grip and hold a fish in said sleeve so that said sleeve holds the fish in said sleeve wherein said acting means controllably releases to enable release of the fish;

(e) a fish guiding, downwardly directed, open bowl having a fish guiding surface to direct the fish upwardly into said sleeve;

(f) a threaded sub at the upper end of said outer mandrel for connection to a tubing string;

(g) a lower and smaller sphere catching shoulder in said mandrel;

(h) an upper and larger sphere catching shoulder in said mandrel; and (i) said upper and lower shoulders each connecting to moveable sleeves to control expansion and release of said sleeve for engaging and releasing of a fish thereby wherein smaller and then larger spheres are dropped into said mandrel to control operation.

17. The apparatus of claim 16 including separate shear pins for said upper and lower shoulders to enable fluid pressure initiated shearing thereof.

18. A soft set overshot comprising:

(a) an elongate outer mandrel to encircle around a fish;

(b) an elongate inner sleeve within said outer mandrel and having an axial passage to fit around an end of the fish wherein said inner sleeve fits within said outer mandrel to position said sleeve around the fish;

(c) means fixedly locating the lower end of said sleeve in said outer mandrel;

(d) means acting on said inner sleeve to expand said inner sleeve radially inwardly to grip and hold a fish in said sleeve so that said sleeve wherein said acting means controllably releases to enable release of the fish; and (e) a fluid receiving chamber within said outer mandrel and external of said sleeve to enable fluid in said chamber to form a fluid initiated force acting against said sleeve to expand said sleeve radially inwardly.

19. The apparatus of claim 18 including a well fluid flow path connected from a tubing string supporting said overshot wherein said flow path connects to said fluid receiving chamber for expansion of said chamber to enable fluid initiated sleeve expansion radially inwardly.

* * * * *